US005775132A

United States Patent [19]

Lonati et al.

[11] Patent Number: 5,775,132

[45] Date of Patent: Jul. 7, 1998

[54] SINKER ARRANGEMENT IN A KNITTING MACHINE AND KNITWORK FORMATION METHODS USING SAID ARRANGEMENT

[75] Inventors: Tiberio Lonati; Fausto Lonati; Ettore Lonati; Francesco Lonati, all of Brescia, Italy

[73] Assignee: Santoni S.r.l., Brescia, Italy

[21] Appl. No.: 509,577

[22] Filed: Jul. 31, 1995

[30] Foreign Application Priority Data

Jul. 29, 1994 [IT] Italy ..... MI9401653

[51] Int. Cl.[6] ..... D04B 9/12; D04B 15/06

[52] U.S. Cl. ..... 66/9 R; 66/91; 66/92; 66/93

[58] Field of Search ..... 66/90, 91, 92, 66/93, 9 R

[56] References Cited

U.S. PATENT DOCUMENTS

| | | | |
|---|---|---|---|
| 4,665,718 | 5/1987 | Jeinek et al. | 66/9 R |
| 5,184,483 | 2/1993 | Conti | 66/93 |

FOREIGN PATENT DOCUMENTS

| | | | |
|---|---|---|---|
| 494545 | 10/1938 | United Kingdom | 66/91 |
| 2038376 | 11/1979 | United Kingdom . | |
| 2085035 | 9/1981 | United Kingdom . | |
| 2160901 | 6/1985 | United Kingdom . | |

*Primary Examiner*—John J. Calvert
*Attorney, Agent, or Firm*—Diller, Ramik & Wight, PC

[57] ABSTRACT

The main object of the invention is to obtain knitwork the density of which is not influenced by the tension of the previously formed loops (15). In the particular case of terry cloth the terries are hence particularly uniform and stable.

This is achieved by operationally interposing the terry sinker (2) between two stitch sinkers (3, 21).

The method for producing terry knitwork is as follows:

the first yarn (12) passes under the stitch hooks (7) while resting on the knocking-over surfaces (8) of the stitch sinkers (3, 21), and then over the terry hook (4) while resting on the terry surface (5) of the terry sinker (2);

the second yarn (13) follows the first yarn (12), but instead of passing over the terry hook (4) passes along the working surface (6) of the terry sinker (2).

The method for producing wide-mesh knitwork comprises for both yarns (12, 13) a path identical to that of the first yarn (12) of the terry knitwork production method.

The method for producing normal knitwork comprises for both yarns (12, 13) a path identical to that of the second yarn (13) of the terry knitwork production method.

20 Claims, 4 Drawing Sheets

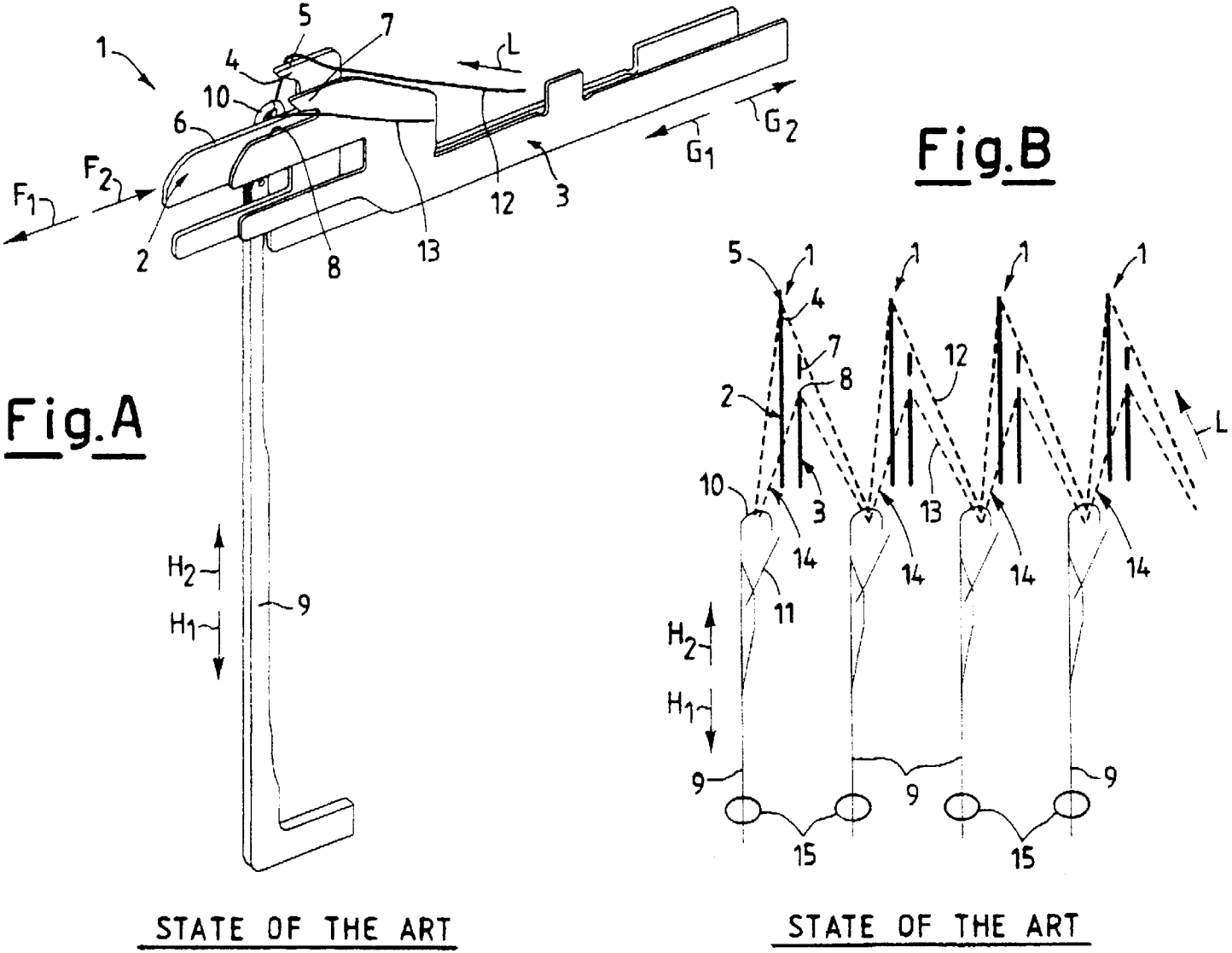
Fig.B
STATE OF THE ART
Fig.A
STATE OF THE ART

SINKER ARRANGEMENT IN A KNITTING MACHINE AND KNITWORK FORMATION METHODS USING SAID ARRANGEMENT

This invention relates to a sinker arrangement in a knitting machine, a terry knitwork production method and a plain knitwork production method.

To facilitate easy understanding of the invention, the known sinker arrangement in a knitting machine will be firstly described See FIGS. A and B).

With reference to said figures, the known arrangement, indicated overall by 1, comprises a terry sinker 2 cooperating with a knitting needle 9. Said arrangement 1 is housed, adjacent to other identical arrangements, in the knitting machine cylinder.

The number of said arrangements present in a knitting machine hence varies according to the machine dimensions and type. The terry sinker 3 comprises a terry hook/ generating a terry surface 5 and a parallel working surface 6. The remaining portions of the terry sinker 2 are profiled, their purpose being to allow the selective reciprocating movement (arrows F1 and F2) of the sinker relative to the knitting machine cylinder (not shown). A detailed description of these remaining portions is omitted because in addition to being known to the expert, they are not significant for the purposes of the present description.

The stitch sinker 3 comprises a stitch hook 7 adjacent to the knocking-over surface 8. Again in this case a detailed description of the remaining portions of the stitch sinker 3 is omitted because in addition to being known to the expert, they are not significant for the purposes of the present description. The remaining portions of the stitch sinker 3 are profiled, their purpose being to allow the selective reciprocating movement (arrows G1 and G2) of the sinker 3 relative to the knitting machine cylinder.

The needle 9 knowingly comprises a head 10 closed by a needle latch 11. The needle slides reciprocatingly in the direction of the arrows H1 and H2. In the traditional method for forming terry knitwork by the described traditional arrangement 1, a first yarn 12 and a second yarn 13 engage the sinkers 2 and 3 in the following manner. The first yarn 12 passes over the terry hook 4 while resting on the terry surface 5 and engages the head 10. The second yarn 13 passes under the stitch hook 7 while resting on the knocking-over surface 8 of the stitch sinker 3, passes under the terry hook 4 while resting on the working surface 6, and penetrates into the head 10 of the needle 9 where it lies to the side of the first yarn 12. The movement of the needle 9 in the direction of the arrow H1 determines the formation of a new stitch by inserting the V-loop 14 into a previous round loop (old loop) 15 which is simultaneously withdrawn and removed from the needle (unloading the stitch from the needle), by the effect of the advancement movement of the previously formed stitch. The V-loop 14 hence becomes a further (old) round loop 15 mounted on the shaft of the needle 9 and ready to receive and link with the next V-loop 14. The process is repeated until a knitwork is obtained having the required number of stitches and hence the required dimensions. This sinker arrangement in a knitting machine and the said knitwork formation method have however the following drawbacks:

the knitwork density obtainable depends on the state of the previous (old) loops and in particular on their tension;

unloading the stitch can be difficult because the loop to be withdrawn and removed from the needle tends to drag the old loops with it (upwards). This occurs particularly if the coefficient of friction between the yarn and the metal reaches a certain value under determined hygroscopic conditions;

if the first yarn breaks, the stitch is not formed; at each stroke the needle then continues to load yarn into the head and as it is unable to unload this yarn it accumulates until the head breaks because of excessive yarn volume. The object of the invention is to overcome the aforesaid problems. The first problem is solved because the knitwork density is determined by the position of that stitch sinker closer to the needle, ie the further stitch sinker. The second problem is solved because the last loop to be formed on the needle shank is prevented from sliding to the top of it by the hook of the sinker closer to the needle, ie the further stitch sinker. The stitches already formed are therefore not used (and hence stressed) to halt the upward sliding of said loop.

The third problem is solved because both the yarns are knocked over on both the knocking-over surfaces of the stitch sinker, to form a loop held by the hooks of said sinkers. Consequently even if one of the two yarns breaks (it is indifferent which), the remainder can in any event form the stitch, which is regularly unloaded from the needle and therefore does not accumulate to break the head. The fact that the knitwork obtained is in any event defective has no influence with regard to possible needle breakage, which as is well known to the expert of the art can be very costly because the resultant pieces of metal can finish up inside moving parts of the machine, causing considerable extension to the original damage.

The invention is illustrated by way of non-limiting example in the further figures of the other drawings.

FIG. 1 is perspective

FIG. A is a perspective view of a known sinker arrangement in a knitting machine which is conventional and hence not illustrated for simplicity.

FIG. B is a schematic front view of the sinker arrangement of FIG. A. and therefore not shown for simplicity. The yarn path is that corresponding to the method for obtaining terry knitwork.

Figures 1, 2:
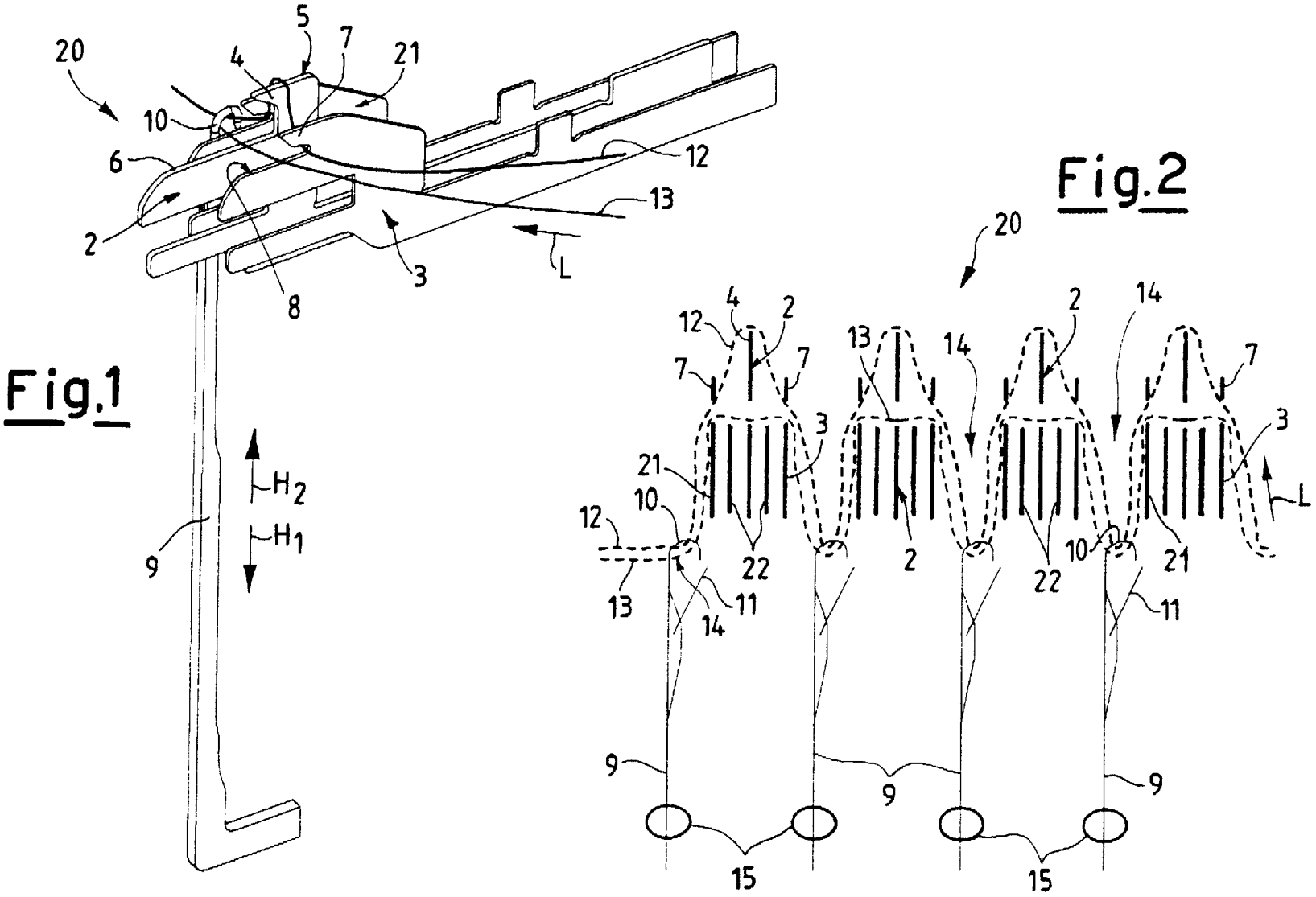
FIG. 2 is a schematic front view of the arrangement of FIG. 1.

The invention is described hereinafter with reference to said FIGS. 1 and 2. In these figures those elements already shown in FIGS. A and B are indicated by the same reference numerals. As can be seen from said figures, the arrangement of the invention, indicated overall by 20, differs from that of the state of the art essentially in that the terry sinker 2 comprises a further stitch sinker 21, and is operationally interposed between the two stitch sinkers 3, 21.

The further or second stitch sinker 21 is identical with the first 3. To facilitate the operability of the arrangement 20, spacer sinkers 22, visible only in FIG. 2, are preferably interposed between the terry sinker 2 and the stitch sinkers 3, 21.

This arrangement enables at least three methods to be implemented for producing a semi-finished or finished knitwork product.

The first method produces terry knitwork; the second method produces a knitwork with wide stitches, ie wide-mesh knitwork; the third method produces a knitwork with normal stitches, ie normal knitwork.

With particular reference to FIGS. 1 and 2, the first method for producing terry knitwork is as follows.

The method uses at least one first yarn 12 and at least one second yarn 13 to be interlocked by a needle 9 positioned laterally to the sinker arrangement 20 according to the invention. Said yarns 12 and 13 extend relative to the sinkers 2, 3 and 21 of said arrangement 20 in the following manner.

The first yarn 12 originating (arrow L) from a first package (not shown) passes under the stitch hook while resting on the knocking-over surface 8 of the first stitch sinker 3, then passes over the terry hook 4 while resting on the terry surface 5 of the terry sinker, then passes under the stitch hook 7 while resting on the knocking-over surface 8 of the second stitch sinker 21, and then passes into the head 10 of the knitting machine needle 9 to terminate within the stitch under production.

The second yarn 13 originating (arrow L) from a second package (also not shown) passes under the stitch hook 7 while resting on the knocking-over surface 8 of the first stitch sinker 3, passes under the terry hook 4 while resting on the working surface 6 of the terry sinker 2, passes under the stitch hook 7 while resting on the knocking-over surface 8 of the second stitch sinker 21, and finally passes into the head 10 of the knitting machine needle 9 to terminate within the stitch under production.

Figure 4:
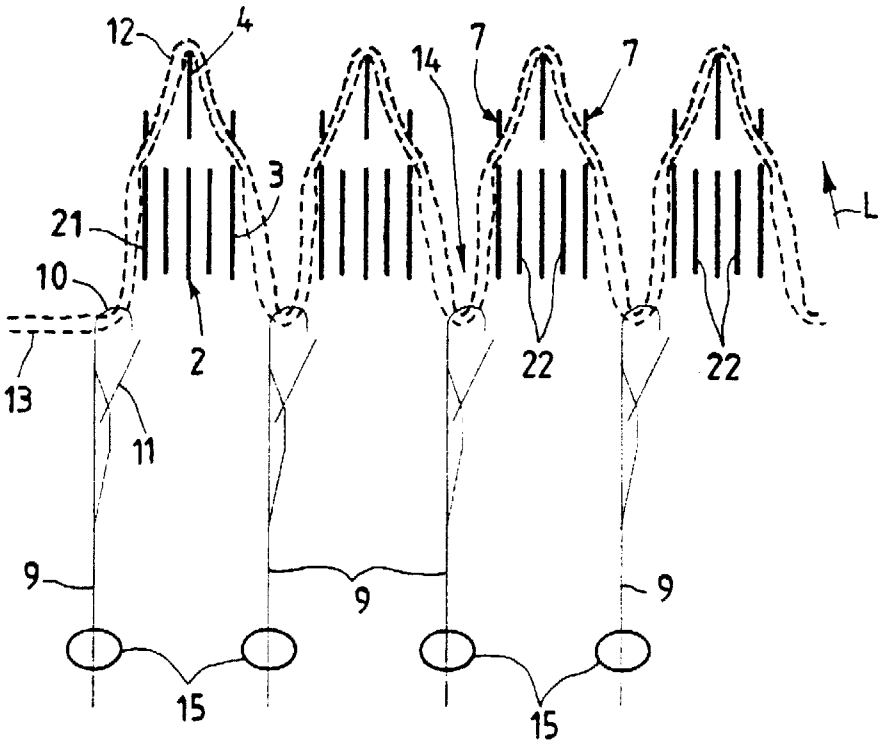
FIG. 4 is a schematic front view of the arrangement of FIG. 3.
Figure 3:
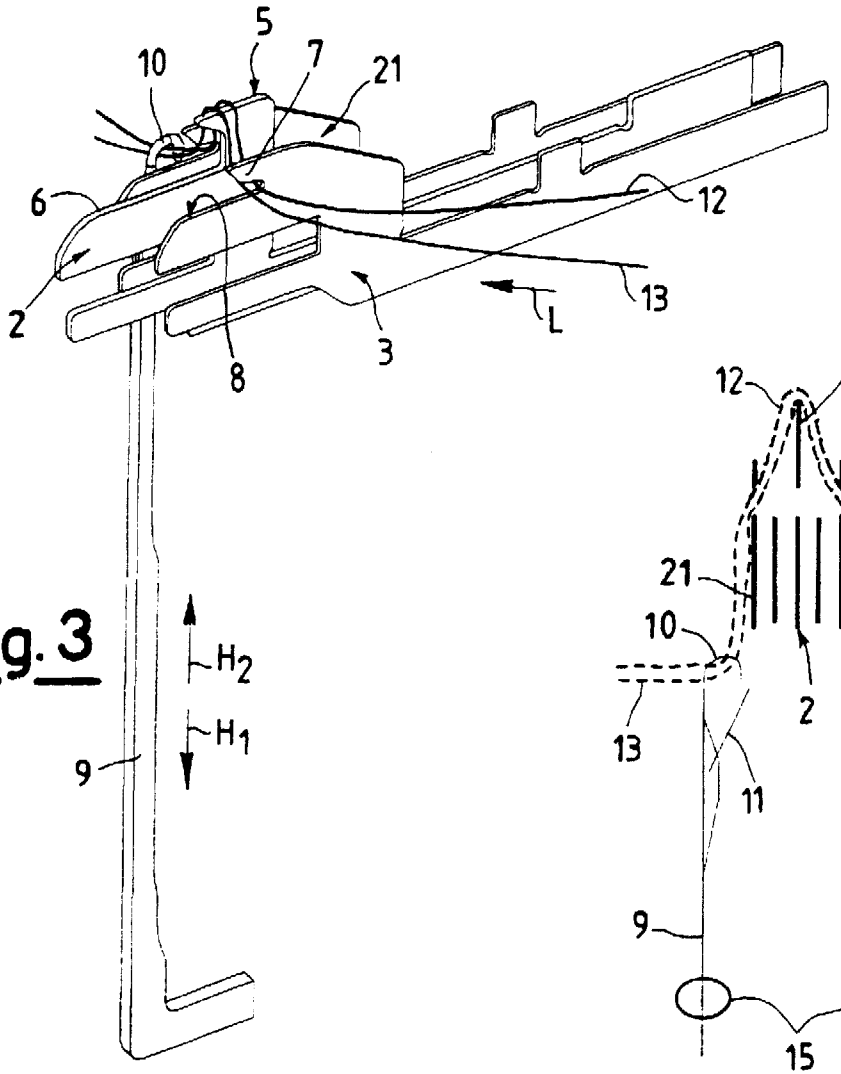
FIG. 3 is a perspective view of a sinker arrangement according to the invention as housed in a conventional knitting machine in which the yarn path is that corresponding to the method for obtaining wide-mesh knitwork.

With particular reference to FIGS. 3 and 4, the second method, for producing wide-mesh knitwork, is as follows.

The method for producing wide-mesh knitwork uses at least one first yarn 12 and at least one second yarn 13 to be interlocked by a needle 9 positioned laterally to the sinker arrangement 20 according to the invention.

Figures 5, 6:
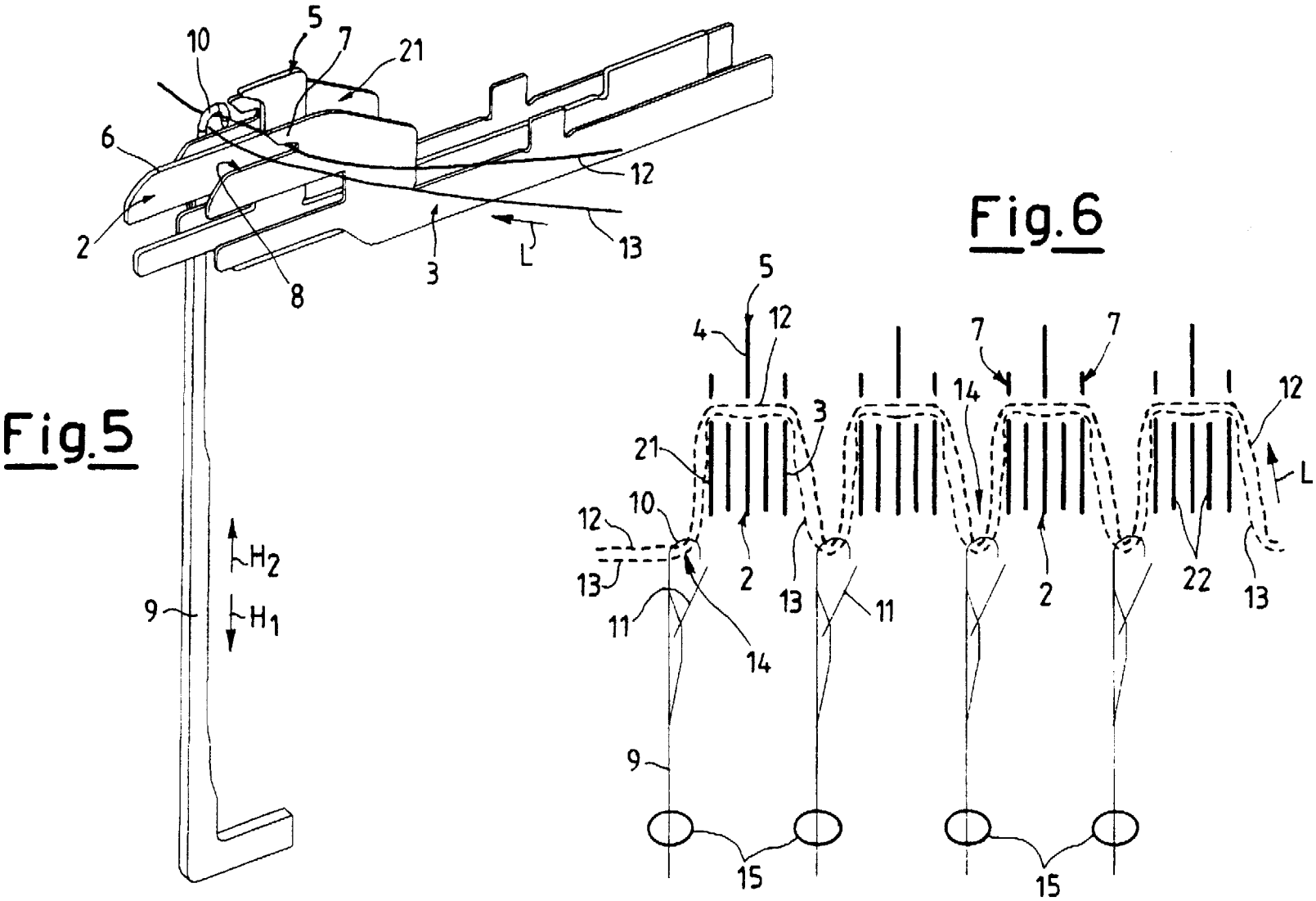
FIG. 5 is a perspective view of a sinker arrangement according to the invention as housed in a conventional knitting machine in which the yarn path is that corresponding to the method for obtaining normal knitwork.
FIG. 6 is a schematic front view of the arrangement of FIG. 5.

Said yarns 12 and 13 extend relative to the sinkers 2, 3 and 21 of said arrangement 20 in the following manner. Both the first yarn 12 and the second yarn 13 originating respectively (arrow L) from the first and second package pass under the stitch hook 7 while resting on the knocking-over surface 8 of the first stitch sinker 3, then pass over the terry hook 4 while resting on the terry surface 5 of the terry sinker 2, then pass under the stitch hook 7 while resting on the knocking-over surface 8 of the second stitch sinker 21 and finally pass into the head 10 of the knitting machine needle 9, to terminate within the stitch under production. With particular reference to FIGS. 5 and 6, the third method, for producing normal knitwork, is as follows.

The method for producing normal knitwork uses at least one first yarn 12 and at least one second yarn 13 to be interlocked by a needle 9 positioned laterally to the sinker arrangement 20 according to the invention. Said yarns 12 and 13 extend relative to the sinkers 2, 3 and 21 of said arrangement 20 in the following manner. Both the first yarn 12 and the second yarn 13 originating respectively (arrow L) from the first and second package pass under the stitch hook 7 while resting on the knocking-over surface 8 of the first stitch sinker 3, then pass under the terry hook 4 while resting on the working surface 6 of the terry sinker 2, then pass under the stitch hook 7 while resting on the knocking-over surface 8 of the second stitch sinker 21 and finally pass into the head 10 of the knitting machine needle 9, to terminate within the stitch under production. All three described methods are preferably implemented under the following conditions:

- the count of the first yarn 12 and of the second yarn 13 are different. In this case a fourth method similar to that shown in FIGS. 1 and 2 can be implemented, with 12 and 13 reversed;
- the count of the first yarn is greater than the count of the second yarn;
- the first yarn 12 is cotton and the second yarn 13 is helanca.

The aforesaid methods can be implemented during the production of one and the same terry cloth by making the usual knitting machine adjustments. Hence stitches can be produced which differ in stitch density either needle by needle (by making a more or less advanced stitch sinker selection) or course by course (by again adjusting the stitch sinkers as in the preceding case or by adjusting the thread guide rise).

It should be noted that the presence of two stitch sinkers to the sides of the terry sinker results for all the aforesaid methods in complete control of the stitch formation stage due to the fact that both the yarns 12 and 13 always pass along knocking-over surfaces 8 of two stitch sinkers 3 and 21 between which there is the terry sinker 2.

From the aforegoing it is apparent that by means of the invention it is possible to obtain on one and the same machine during the production of one and the same terry cloth a large number of stitch types which are very different from each other, so increasing the available weaves and knitwork densities, and hence the versatility and comfort of the product. So-called "special" stitches can also be obtained by alternating wide stitches with narrow stitches, achieved simply by arranging the sinkers in a suitable manner, ie in different positions achieved by different heights of the needle butts.

We claim:

1. A sinker arrangement (20) for a knitting machine comprising a terry sinker (2) located between two stitch sinkers (3, 21), said terry sinker (2) having a working surface (6) located in a plane below a plane of a terry surface (5) of a terry hook (4), each of said stitch sinkers (3, 21) having a knocking-over surface (8) located in a plane below a stitch hook (7), and said terry hook (4) and stitch hooks (7) are directed in the same direction with said terry hook (4) being disposed above said stitch hooks (7).

2. The sinker arrangement as defined in claim 1 including a spacer sinker (22) located between said terry sinker (2) and said stitch sinkers (3, 21).

3. The sinker arrangement as defined in claim 1 including a plurality of identical terry sinkers.

4. The sinker arrangement as defined in claim 1 wherein said sinker arrangement (20) is adopted for utilization on a circular knitting machine.

5. The sinker arrangement as defined in claim 2 wherein said sinker arrangement (20) is adopted for utilization on a circular knitting machine.

6. A method of producing terry knitwork using at least one first yarn (12) and at least one second yarn (13) to be interlocked by a needle (9) positioned laterally to a sinker arrangement (20) characterised in that the yarns (12, 13) extend relative to a terry sinker (2) located between stitch sinkers (3, 21) of the sinker arrangement (20) in the following manner:

the first yarn (12) originating from a first package passes under a stitch hook (7) while resting on a knocking-over surface (8) of the first stitch sinker (3), then passes over a terry hook (4) while resting on a terry surface (5) of the terry sinker (2), then passes under a stitch hook (7) while resting on a knocking-over surface (8) of the second stitch sinker (21), and then passes into a head (10) of a knitting machine needle (9) to terminate within the stitch under production;

the second yarn (13) originating from a second package passes under the stitch hook (7) while resting on the knocking-over surface (8) of the first stitch sinker (3), passes under the terry hook (4) while resting on the working surface (6) of the terry sinker (2), passes under the stitch hook (7) while resting on the knocking-over surface (8) of the second stitch sinker (21), and passes into the head (10) of the knitting machine needle (9) to terminate within the stitch under production.

7. A method as claimed in claim 6, characterised in that the yarns (12, 13) have different counts and are reversed.

8. A method for producing wide-mesh knitwork using at least one first yarn (12) and at least one second yarn (13) to be interlocked by a needle (9) positioned laterally to a sinker arrangement (20) characterised in that the yarns (12, 13) extend relative to a terry sinker (2) located between stitch sinkers (3, 21) of the sinker arrangement (20) in the following manner: both the first yarn (12) and the second yarn (13) originating respectively from a first and a second package pass under a stitch hook (7) while resting on a knocking-over surface (8) of a first stitch sinker (3), then pass over a terry hook (4) while resting on a terry surface (5) of the terry sinker (2), then pass under a stitch hook (7) while resting on a knocking-over surface (8) of a second stitch sinker (21) and finally pass into a head (10) of the knitting machine needle (9), to terminate within the stitch under production.

9. A method for producing normal knitwork using at least one first yarn (12) and at least one second yarn (13) to be interlocked by a needle (9) positioned laterally to a sinker arrangement (20) characterised in that the first and second yarns (12, 13) extend relative to a terry sinker (2) located between stitch sinkers (3, 21) of the sinker arrangement (20) in the following manner: both the first yarn (12) and the second yarn (13) originating respectively from a first and from a second package pass under a stitch hook (7) while resting on a knocking-over surface (8) of a first stitch sinker (3), then pass under a terry hook (4) while resting on a working surface (6)of the terry sinker (2), then pass under a stitch hook (7) while resting on a knocking-over surface (8) of a second stitch sinker (21) and finally pass into a head (10) of the knitting machine needle (9), to terminate within the stitch under production.

10. A method as claimed in claim 6, characterised in that the count of the first yarn (12) is different from the count of the second yarn (13).

11. A method as claimed in claim 7, characterised in that the count of the first yarn (12) is different from the count of the second yarn (13).

12. A method as claimed in claim 8, characterised in that the count of the first yarn (12) is different from the count of the second yarn (13).

13. A method as claimed in claim 6, characterised in that the count of the first yarn (12) is greater than the count of the second yarn (13).

14. A method as claimed in claim 7, characterised in that the count of the first yarn (12) is greater than the count of the second yarn (13).

15. A method as claimed in claim 8, characterised in that the count of the first yarn (12) is greater than the count of the second yarn (13).

16. A method as claimed in claim 6, characterised in that the first yarn (12) is cotton and the second yarn (13) is helanca.

17. A method as claimed in claim 7, characterised in that the first yarn (12) is cotton and the second yarn (13) is helanca.

18. A method as claimed in claim 8, characterised in that the first yarn (12) is cotton and the second yarn (13) is helanca.

19. A method as claimed in claim 9, characterised in that the first yarn (12) is cotton and the second yarn (13) is helanca.

20. The sinker arrangement as defined in claim 3 wherein said sinker arrangement (20) is adopted for utilization on a circular knitting machine.

* * * * *